United States Patent [19]

Stahlecker

[11] Patent Number: 4,677,820

[45] Date of Patent: Jul. 7, 1987

[54] SUCTION CONTROL ARRANGEMENT FOR OPEN-END FRICTION SPINNING

[75] Inventor: Fritz Stahlecker, Josef-Neidhart-Strasse 18, 7347 Bad Ueberkingen, Fed. Rep. of Germany

[73] Assignees: Fritz Stahlecker; Hans Stahlecker, both of Fed. Rep. of Germany

[21] Appl. No.: 847,475

[22] Filed: Apr. 3, 1986

[30] Foreign Application Priority Data

Apr. 25, 1985 [DE] Fed. Rep. of Germany ..... 3514905

[51] Int. Cl.[4] ..... D01H 15/02; D01H 1/135; D01H 7/898

[52] U.S. Cl. ..... 57/401; 57/263

[58] Field of Search ..... 57/400, 401, 404, 406, 57/408, 411, 263

[56] References Cited

U.S. PATENT DOCUMENTS

| | | | |
|---|---|---|---|
| 4,522,023 | 6/1985 | Stahlecker | 57/401 |
| 4,539,804 | 9/1985 | Derichs | 57/401 X |
| 4,541,234 | 9/1985 | Wassenhoven et al. | 57/401 X |
| 4,601,166 | 7/1986 | Raasch | 57/401 |

*Primary Examiner*—Donald Watkins
*Attorney, Agent, or Firm*—Barnes & Thornburg

[57] ABSTRACT

An apparatus for open-end friction spinning is provided with at least one suction roller connected to a suction device. The suction device is connected via a valve with an underpressure or vacuum source which permits the adjustment and the switching off of the suction effect of the suction device. Adjusting elements operating independently of each other are respectively provided for switching off of the suction effect and for controlling the amount of the suction effect. These adjusting elements are operable by a moveable servicing apparatus.

18 Claims, 2 Drawing Figures

SUCTION CONTROL ARRANGEMENT FOR OPEN-END FRICTION SPINNING

BACKGROUND AND SUMMARY OF THE INVENTION

The invention relates to an open-end friction spinning machine having at least one friction surface assigned to a suction device which is connected to an underpressure or vacuum source via a valve that regulates the magnitude of the suction effect and the switching off of the suction device.

In a known apparatus of the above-mentioned type described in commonly owned U.S. Pat. No. 4,522,023 issued June 11, 1985, the friction surface is configured as a wedge-shaped gap between two adjacently arranged rollers. At least one of the two rollers exhibits a perforated cover surface containing a suction pipe of a suction device inside. This suction device is connected to an underpressure or vacuum source by means of a blocking and controlling valve allowing the switching on and switching off of the suction effect of the suction device. In practice difficulties were recognized in designing and operating a blocking and control valve in such a manner, that after the suction effect of the suction device was shut off and again resumed, it is exactly the same as before. Thereby it has to also be recognized that many such open-end friction spinning units are combined to form a single machine whereby each of these open-end friction spinning units may exhibit a slightly different setting of the suction effect.

The invention is based on the objective to so develop an apparatus of the above-mentioned type wherein the valve is selectively operable so as to again obtain the exact same suction effect as the prior setting.

This objective is achieved according to the present invention by providing individually operable adjusting means for switching off and for adjusting the suction effect of the suction device at a respective spinning unit.

With the arrangement of the present invention, the suction effect of the suction device usually regulated in very tight tolerances does not change whenever the suction device is shut off, for example, during a yarn breakage and a subsequent piecing process. The setting of the valve does not change during this process.

In a further development of certain preferred embodiments of the invention, it is provided that the adjusting means for switching off the suction effect in the suction device includes an actuator controllable by a yarn breakage guard. It is thereby achieved that during a yarn breakage, the suction effect is automatically interrupted and the friction effect at the friction surface is immediately reduced. Any fiber residues that could possibly remain, are easily removed during a cleaning process. In an advantageous development of certain preferred embodiments, a return or reset element of a movable servicing apparatus for switching on the suction effect is assigned to the actuator of the adjusting means that switches off the suction effect of the suction device. This moveable servicing apparatus automatically attends to again switching on the suction effect at the appropriate time period during the piecing process.

In a further development of certain preferred embodiments of the invention, it is provided that the adjusting means of the valve includes an adjustable stop for limiting the movement of a valve body towards its opening position. This stop, that is not changed during the switching off of the suction effect, determines the suction for the normal operational condition. In an advantageous further development, a moveable servicing apparatus is provided which includes means for regulating the adjustable stop. The precise setting of the suction effect desired for the normal operational condition is then performed by the servicing apparatus. The normal operational condition is not changed each time the operation is interrupted and the suction effect discontinued, which means that the suction effect is again precisely the same after an interruption in the operation.

In an advantageous embodiment of the invention, the valve is configured as a flap or leaf valve arranged with the flap or leaf on a shaft and the adjusting means engaging at the shaft of the flap or leaf. This results in a simple, but at the same time also, precise adjustment mechanism. In an advantageous further development a radially directed counter stop is attached at the shaft that corresponds with the adjustable stop limiting the opening position. Furthermore, it is advantageous if the shaft is connected to a spring loading the same in the opening direction of the valve and retaining same in said opening position determined by the stop, wherein the closing movement of the valve for switching off the suction effect occurs against the effect of the spring. This results in a very simple but very precise mechanism permitting a fast switching off of the suction effect of the suction device as well as a fast re-activation of the suction effect to the pre-existing value.

In a further development of preferred embodiments of the invention, at least one cleaning device connectable to the underpressure or vacuum source of the suction device via a valve is provided having adjusting means that are controlled in such a manner that simultaneously with the switching off of the suction effect of the suction device, the cleaning device is switched off.

Further objects, features, and advantages of the present invention will become more apparent from the following description when taken with the accompanying drawings which show, for purposes of illustration only, an embodiment/several embodiments in accordance with the present invention.

DETAILED DESCRIPTION OF THE DRAWINGS

Figure 1:
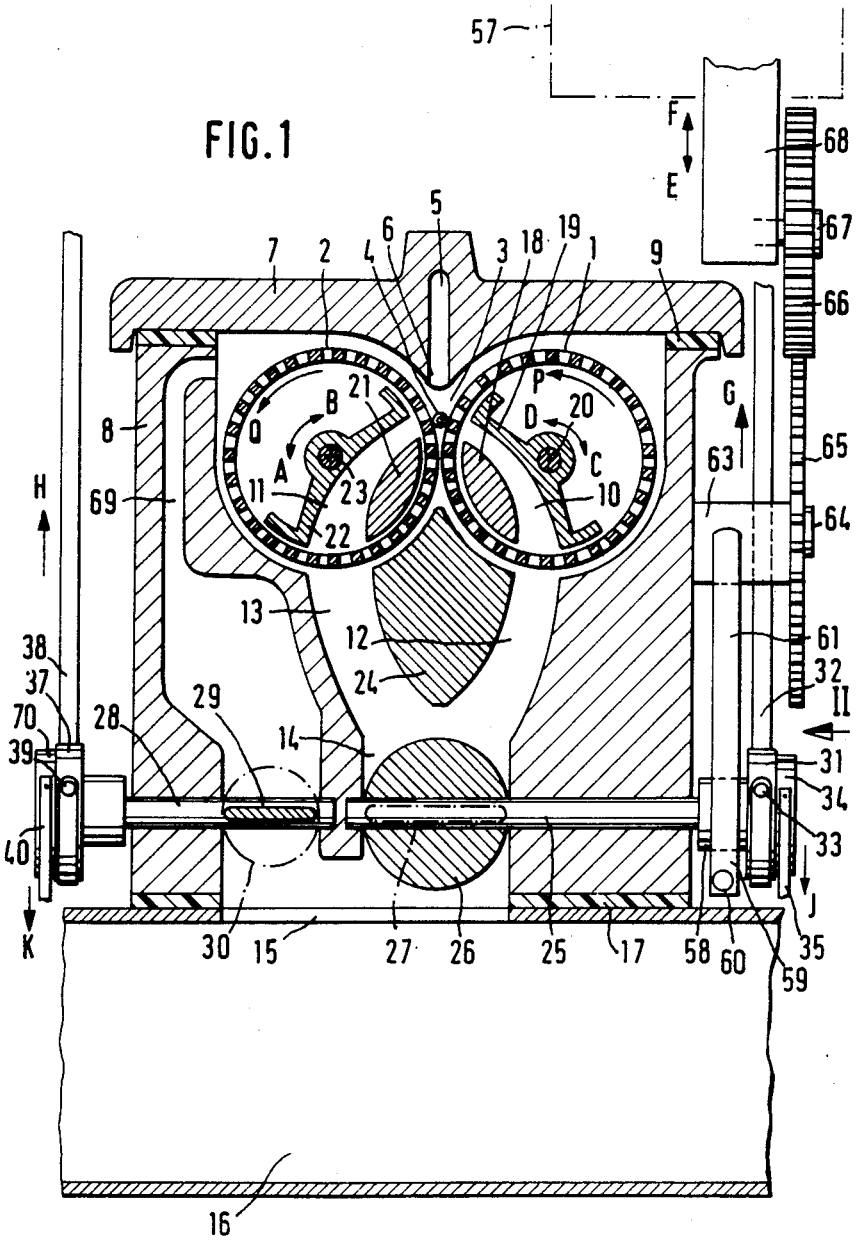
FIG. 1 is a partial sectional schematic view through an open-end friction spinning unit of a spinning machine comprising a plurality of such spinning units, including a servicing apparatus permitting the adjustment of the suction effect of the suction devices at the spinning units, constructed in accordance with preferred embodiments of the present invention.

The illustrated apparatus includes a friction surface region where the yarn forming occurs that is formed into the shape of a wedge-shaped gap 3 by two closely adjacent suction friction rollers 1 and 2. The suction rollers 1 and 2 are driven in the same rotational direction indicated by arrows P and Q by means not further illustrated here. In a practical machine, a plurality of such units are adjacently arranged next to each other in a row. Fibers are fed to the wedge-shaped gap 3 via fiber feeding channel 5, which fibers are twisted together in the wedge-shaped gap 3 to form a yarn 4 which is withdrawn in the longitudinal direction of the wedged-shaped gap 3 by means of a withdrawal device not further illustrated here. A known feeding and opening device which opens up a fiber sliver into single fibers is disposed upstream of the fiber feeding channel 5 and channel 5 extends with its slot-like mouth or opening 6 in the direction of the wedge-shaped gap 3.

The suction rollers 1 and 2 are, in a not further illustrated manner, borne in roller housing 8 which is sealingly connected through insertion of an elastic sealing element 9 to a cover-like component part 7 containing the fiber feeding channel 5. The shells of the suction rollers 1 and 2 are provided with perforations at least in the area of the opening 6 of the fiber feeding channel 5. A suction duct 10 and 11 is respectively provided inside the suction rollers 1 and 2 for producing an air current through the perforations thereof that flows laterally through said suction rollers 1 and 2. The fiber transport within the fiber feeding channel 5 is at least supported by this air current, while, on the other hand, this air current retains the fibers and the forming yarn 4 in the wedge-shaped gap 3.

The suction ducts 10 and 11 extending laterally through the suction rollers 1 and 2 are provided with connecting ducts 12 and 13 directed upon the cover surfaces of suction rollers 1 and 2 at the exit port of these suction ducts 10 and 11. The connecting ducts 12 and 13 are combined into a collecting channel 14 which is connected via a connector opening 15 to an underpressure or vacuum line 16 extending in the longitudinal direction of the spinning machine. An elastic sealing means 17 is arranged between the roller housing 8 and the vacuum line 16.

The suction ducts 10 and 11 inside of the suction rollers 1 and 2 are provided with inserts 18, 19, 21, 22 which determine the cross-section of the suction ducts 10 and 11. The suction inserts 18, 19, and 21, 22 are fitted with their exterior sides to the inner surfaces of suction rollers 1 and 2 in such a manner that a certain sealing gap is formed. The inserts 19 and 20 are adjustable in direction of arrows A, B, D, and C about axes 20 and 23 of suction rollers 1 and 2 allowing adjustment of the entrance ports of the suction ducts 10 and 11 with respect to the wedge-shaped gap 3. The connector ducts 12 and 13 are separated from each other by means of a fitted piece 24.

The collector duct 14 has a cylindrical cross-section and includes a flap or leaf valve having a rotatable shaft 25 and a flap 26 arranged thereupon, shaft 25 extending is transversely to the collector duct 14. In FIG. 1 flap 26 is shown in solid lines in the opening position of the valve. By rotating the shaft 25 around 90 degrees, the flap 26 is moved into the dotted-line position 27 closing the collector channel 14.

A disc 31 is fixedly attached to the end of the shaft 25 protruding out of the roller housing 8. Disc 31 is surrounded by a tension band 32 secured by means of a screw 33 or the like to the disc 31. Furthermore disc 31 is fixedly connected to another disc 34 having another tension band 35 extending in a counter-clockwise manner with respect to the tension band 32. Band 35 is fixedly attached by means of a tension spring 36 to a stationary mounting element.

The tension band 32 is guided about deflection rollers 43, 44, and 45 and is attached by means of a fastening element 48 to a bolt 47 guided in a shell-like sliding guide 49. The bolt 47 includes at one side an upright projection 50 at which is arranged an actuator 52 formed as a magnetic element piston which pushes, with its piston 51 and via the protrusion 50, the bolt 47 into the sliding guide means 49 until the protrusion 50 comes to rest against the abutment end face 54 of the sliding guide means 49 serving as a stop. The actuator 52 is connected via an electrical line 53 to a yarn breakage guard that is not shown here which activates the actuator 52 upon a yarn breakage such that piston 51 is driven out in the direction of arrow L. The shaft 25 together with flap 26 is rotated via the tension band 32 such that the flap assumes the dotted-line position 27 closing off the collector channel 14 and thereby interrupting the suction effect in the suction ducts 10 and 11.

The side of protrusion 50 of bolt 47 which faces opposite the actuator 52 is in facing relationship to lever 56 of a movable servicing apparatus 57. Lever 56 accommodates the return of the protrusion 50 in the direction of arrow M, to the operational position shown, and thereby also piston 51, via its protrusion 55 here. The timing of the return movement is determined by the movable servicing apparatus 57 which presets, for example, a time period suitable for the piecing process. After the return of the actuator 52 into the operational position, the tension spring 36 and band 35 rotates the shaft 25 together with the flap 26 back into the operational position.

The disc 31 arranged on shaft 25 exhibits a ring coller 58, a counter stop in the form of a lever 61 is attached thereupon by means of tensioning member 59 including a tensioning screw 60. The counter stop 61 stationarily connected with the shaft 25 is brought into engagement against an eccentric stop 63 by the spring 36. Eccentric stop 63 is adjustable about its axle 64 thereby defining the operational position of shaft 25 via this eccentric stop 63 and the counter stop 61 and thereby the opening position of the flap 26.

The servicing apparatus 57 adjusts the eccentric stop 63 from the outside and thereby adjusts the opening position of the valve and the suction effect in the suction channels 10 and 11.

The axle 64 of the eccentric stop 63 is stationarily connected with a toothed wheel 65 or a toothed segment which is engageable with a toothed wheel 66 of the servicing apparatus 57, toothed wheel 66 being movable in arrow directions E and F. The toothed wheel 66 with its shaft 67 is arranged upon an adjustable lever 68.

The above-described apparatus for open-end friction spinning is additionally provided with a cleaning device including essentially a cleaning duct 69 which is also connected via the connector opening or port 15 to the underpressure or vacuum line 16. The suction opening of the cleaning duct 69 is positioned in an area opposite the wedge-shaped gap 3 at least at the circumference of a suction roller 2. In the connecting area to the connector opening 15 of the vacuum line 16, a flap or leaf valve 28, 29 is arranged in the widened end of cylindrically formed channel 69. This flap valve includes a shaft 28 supported in the roller housing 8 and a flap 29 arranged thereup. In the operational mode, flap 29 takes on the shown position blocking off the cleaning channel. By rotating the shaft 28 about 90 degrees, flap 29 is brought into the position shown in dotted lines. The flap valve 28, 29 is formed and arranged in such a manner that it is controlled in an opposite direction with respect to the flap valve 25 and 26, which means only one of the flap valves 25, 26 or 28, 29 is respectively opened at one time. This could be accomplished in a simple manner according to certain embodiments of the invention by providing that the flaps 26 and 29 are off-set 90° from one another on the same shaft 25. By accounting for the circumstance that valve 26 is adjustable for metering the suction effect, shafts 25 and 28 are adjustable independently from each other in the illustrated arrangement.

Figure 2:
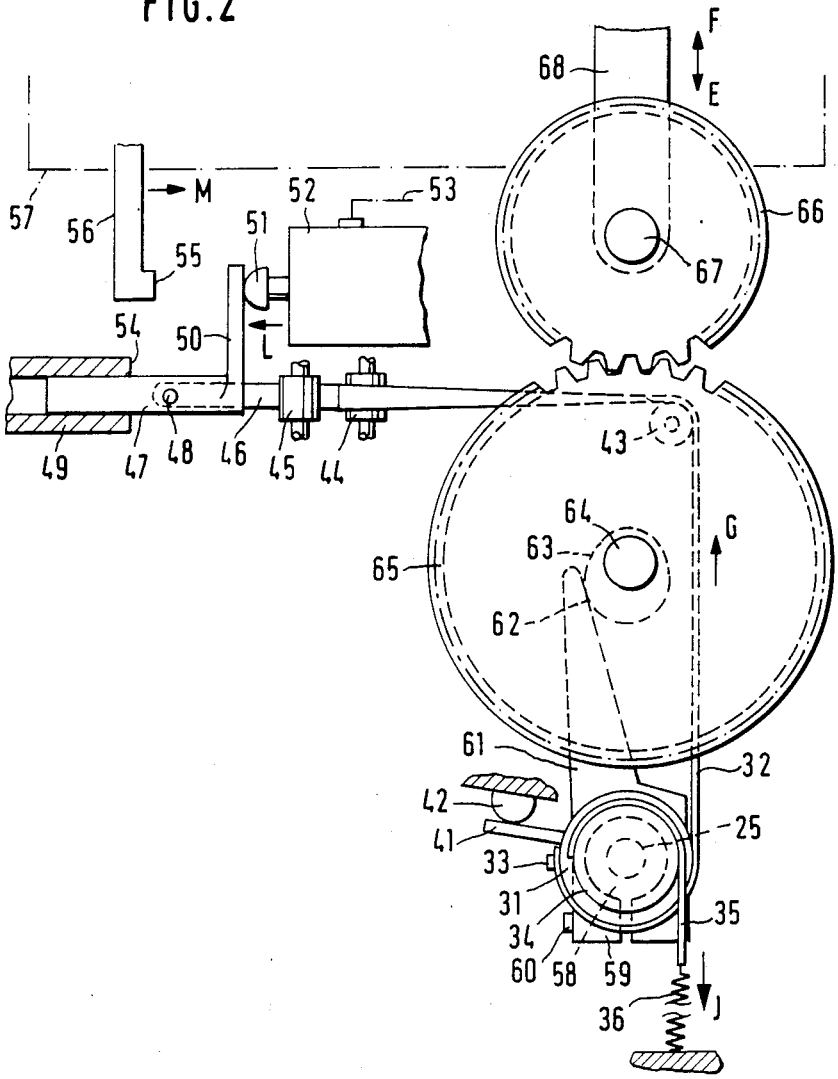
FIG. 2 is a partial schematic top view taken in arrow direction II of FIG. 1.

The shaft 28 is provided with a double disc 37, 70 having two tension bands 38 and 40 working in opposite directions and attached by means of fastening elements. Tension bands 38 and 40 are guided in a manner corresponding to the tension bands 32 and 35 described above and are not shown FIG. 2. The tension band 38 is guided in a similar way as the tension band via deflection rollers such that it cooperates with the tension band 32 in the area of the deflection rollers 44 and 45. Band 38 is also attached to the bolt 47 and operates simultaneously and together with the tension band 32. A radially protruding lever arm 41 is attached at the shaft 28 or a ring collar of the double disc 37, 70 having a stationarily arranged stop 42. This stationary stop 42 determines the closing position of flap 29 in full operation with the lever arm 41.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for open-end friction spinning comprising:

movable friction surface means defining a yarn forming region, suction device means acting on said yarn forming region, valve means for interrupting operation of the suction device means when spinning operations are interrupted and for controlling the magnitude of suction applied during spinning operations, suction device interruption adjusting means for adjusting the movement of the valve means to a position for accommodating interruption of the spinning operations, and suction device control adjusting means for adjusting the control of the valve means to control the magnitude of suction applied during spinning operations, said suction device control adjusting means operating independently of said suction device interruption adjusting means.

2. Apparatus according to claim 1, wherein the suction device interruption adjusting means includes an actuator controlled by a yarn breakage guard for switching off the suction effect of the suction device means.

3. Apparatus according to claim 2, wherein the actuator of the suction device interruption adjusting means is assigned a return element of a moveable servicing apparatus for again activating the suction effect.

4. Apparatus according to claim 1, wherein the suction device control adjusting means include an adjustable stop limiting the movement of a valve body of the valve means with respect to its opening position.

5. Apparatus according to claim 4, wherein a moveable servicing apparatus is provided which has regulation means for regulating the adjustable stop.

6. Apparatus according to claim 1, wherein the valve means is configured as a flap valve having a flap arranged upon a valve shaft, and wherein the adjusting means engages at the same valve shaft of the valve flap.

7. Apparatus according to claim 6, wherein a radially directed counter-stop is provided at the valve shaft to which is assigned an adjustable stop limiting the opening position of the valve flap.

8. Apparatus according to claim 7, wherein the valve shaft is connected to a spring loading the valve shaft in the opening direction of the valve flap and retaining same in the opening position determined by the adjustable stop, and wherein the closing movement of the valve flap for interruption of the suction effect occurs against the effect of the spring.

9. Apparatus according to claim 1, wherein at least one cleaning device is provided which is connectable via a cleaning valve to an underpressure source of the suction device means, said cleaning valve including cleaning adjusting means controllable in such a manner that the cleaning device is activated upon an interruption the suction effect of the suction device means.

10. Apparatus according to claim 1, wherein said suction device interruption adjusting means and said suction device control adjusting means are operable independently of one another.

11. Apparatus according to claim 7, wherein at least one cleaning device is provided which is connectable via a cleaning valve to an underpressure source of the suction device means, said cleaning valve including cleaning adjusting means controllable in such a manner that the cleaning device is activated upon an interruption of the suction effect of the suction device means.

12. Apparatus according to claim 5, wherein at least one cleaning device is provided which is connectable via a cleaning valve to an underpressure source of the suction device means, said cleaning valve including cleaning adjusting means controllable in such a manner that the cleaning device is activated upon an interruption of the suction effect of the suction device means.

13. Apparatus according to claim 10, wherein said friction surface means is formed by surfaces of rotating friction rollers.

14. Apparatus according to claim 13, wherein said friction rollers are disposed adjacent one another and rotated in the same direction, said friction surface means being formed as a gap between the exterior surfaces of the friction rollers.

15. Apparatus for open-end friction spinning comprising:

a movable friction surface means for defining a yarn forming region, suction device means acting on said yarn forming region, valve means for interrupting operation of the suction device means when spinning operations are interrupted and for controlling the magnitude of suction applied during spinning operations, suction device interruption adjusting means for adjusting the movement of the valve means to a position for accommodating interruption of the spinning operations, and suction device control adjusting means for adjusting the control of the valve means to control the magnitude of suction applied during spinning operations, wherein the valve means is configured as a flap valve having a flap arranged upon a valve shaft, and wherein the adjusting means engages at the same valve shaft of the valve flap.

16. Apparatus according to claim 15, wherein a radially directed counter-stop is provided at the valve shaft to which is assigned an adjustable stop limiting the opening position of the valve flap.

17. Apparatus according to claim 16, wherein the valve shaft is connected to a spring loading the valve shaft in the opening direction of the valve flap and retaining same in the opening position determined by the adjustable stop, and wherein the closing movement of the valve flap for interruption of the suction effect occurs against the effect of the spring.

18. Apparatus according to claim 16, wherein at least one cleaning device is provided which is connectable via a cleaning valve to an underpressure source of the suction device means, said cleaning valve including cleaning adjusting means controllable in such a manner that the cleaning device is activated upon an interruption of the suction effect of the suction device means.

* * * * *